US007972448B2

(12) United States Patent
Reppel

(10) Patent No.: US 7,972,448 B2
(45) Date of Patent: Jul. 5, 2011

(54) METHOD FOR THE PRODUCTION OF AN ANISOTROPIC MAGNETIC POWDER AND A BONDED ANISOTROPIC MAGNET PRODUCED THEREFROM

(75) Inventor: Georg Werner Reppel, Hammersbach (DE)

(73) Assignee: Vacuumschmelze GmbH & Co. KG, Hanau (DE)

( * ) Notice: Subject to any disclaimer, the term of this patent is extended or adjusted under 35 U.S.C. 154(b) by 642 days.

(21) Appl. No.: 10/524,752

(22) PCT Filed: Nov. 27, 2003

(86) PCT No.: PCT/EP03/13383

§ 371 (c)(1),
(2), (4) Date: Jul. 7, 2005

(87) PCT Pub. No.: WO2004/049359

PCT Pub. Date: Jun. 10, 2004

(65) Prior Publication Data

US 2006/0162821 A1 Jul. 27, 2006

(30) Foreign Application Priority Data

Nov. 28, 2002 (DE) ..... 102 55 604

(51) Int. Cl.
*H01F 1/032* (2006.01)
*H01F 1/057* (2006.01)

(52) U.S. Cl. ..... 148/122; 148/101; 148/105

(58) Field of Classification Search ..... None
See application file for complete search history.

(56) References Cited

U.S. PATENT DOCUMENTS

| | | | | |
|---|---|---|---|---|
| 4,981,532 | A | 1/1991 | Takeshita et al. | |
| 5,049,208 | A * | 9/1991 | Yajima et al. | 148/302 |
| 5,091,020 | A | 2/1992 | Kim | |
| 5,110,374 | A * | 5/1992 | Takeshita et al. | 148/101 |
| 5,228,930 | A * | 7/1993 | Nakayama et al. | 148/302 |
| 5,314,548 | A | 5/1994 | Panchanathan et al. | |
| 5,580,396 | A * | 12/1996 | Fruchart et al. | 148/101 |
| 5,993,732 | A * | 11/1999 | Nakayama et al. | 419/31 |
| 6,149,861 | A * | 11/2000 | Kaneko et al. | 419/29 |
| 6,290,782 | B1 * | 9/2001 | Sakurada et al. | 148/302 |
| 6,444,052 | B1 | 9/2002 | Honkura et al. | |

(Continued)

FOREIGN PATENT DOCUMENTS

DE 693 15 807 T4 5/1994

(Continued)

OTHER PUBLICATIONS

ASM Materials Engineering Dictionary, 1992, p. 211.*

(Continued)

*Primary Examiner* — John P Sheehan
(74) *Attorney, Agent, or Firm* — Buchanan Ingersoll & Rooney

(57) ABSTRACT

Disclosed herein is a method for the production of an anisotropic magnetic powder or a magnet produced from said powder, wherein a hydrogenating and dehydrogenating method is applied to the starting material in order to produce the powder. An anisotropic oriented magnetic material, more particularly magnetic scrap metal, is advantageously used as starting material so that the complicated use of a molten mass with isotropic distribution of the c axes of the hard metal crystals is not required. The result is an anisotropic material having a fine grain structure and a crystallographic orientation matching a $TM_XB$ phase formed during hydrogenation.

28 Claims, 3 Drawing Sheets

U.S. PATENT DOCUMENTS

| | | | | |
|---|---|---|---|---|
| 2002/0059965 | A1* | 5/2002 | Honkura et al. | 148/105 |
| 2003/0209294 | A1* | 11/2003 | Honkura et al. | 148/302 |
| 2005/0067052 | A1* | 3/2005 | Honkura et al. | 148/105 |

FOREIGN PATENT DOCUMENTS

| | | | |
|---|---|---|---|
| DE | 197 47 364 | A1 | 5/1998 |
| DE | 197 51 367 | A1 | 6/1999 |
| DE | 198 43 883 | C1 | 10/1999 |
| DE | 199 50 835 | A1 | 5/2001 |
| EP | 0 924 720 | A2 | 6/1999 |
| EP | 1 191 553 | A2 | 3/2002 |
| JP | 61-179803 | | 8/1986 |
| JP | 06-151130 | A | 5/1994 |
| JP | 10-032113 | | 2/1998 |
| JP | 2002-105503 | | 4/2002 |
| JP | 2002-161302 | A | 6/2002 |
| JP | 2002-180211 | A | 6/2002 |
| JP | 2002-237406 | | 8/2002 |

OTHER PUBLICATIONS

Gutfleisch, et al., 'Texture Inducement During HDDR Processing of NdFeB,' *IEEE Transaction on Magnetics*, 38(5):2958-2960 (2002).

Japanese Notification of Reasons for Refusal issued on Aug. 11, 2009.

Japanese Office Action dated Aug. 27, 2010 for Japanese Application No. 2004-554511.

* cited by examiner

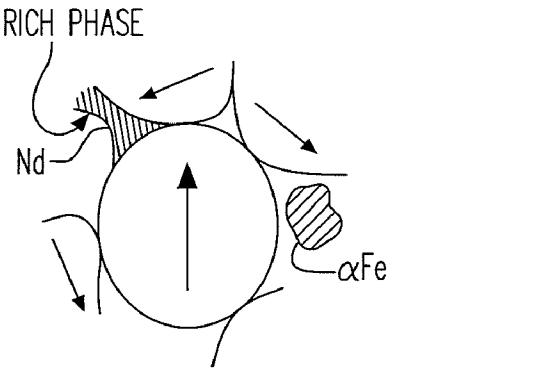

GRAIN OF THE PARENT ALLOY: ARROWS INDICATE THE CRYSTALLOGRAPHIC ORIENTATION OF THE c-AXIS

FIG. 2a

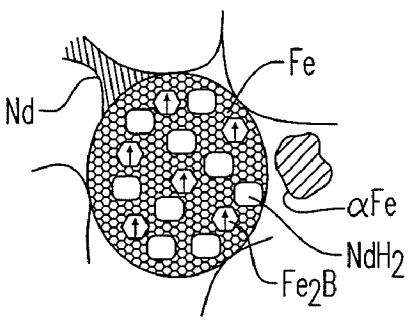

MIXTURE OF $RH_2$, Fe AND $Fe_2B$: ARROWS DENOTE THE CRYSTALLOGRAPHIC ORIENTATION OF THE c-AXIS OF THE $Fe_2B$ PHASE (ORIENTATION OF $Fe_2B$ AND PARENT ALLOY SHOW A GOOD CORRESPONDENCE)

FIG. 2b

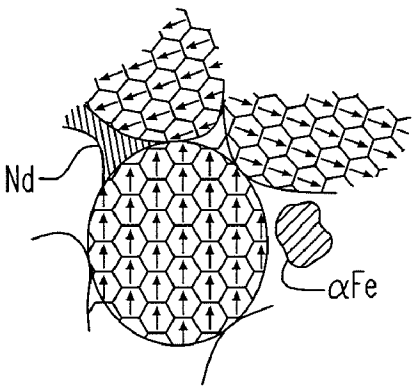

RECOMBINANT MICROSTRUCTURE: ARROWS INDICATE CRYSTALLOGRAPHIC ORIENTATION OF THE c-AXIS OF $R_2Fe_{14}BH_x$ PHASE (ORIENTATION OF THE $R_2Fe_{14}BH_x$ PHASES MATCHES)

FIG. 2c

METHOD FOR THE PRODUCTION OF AN ANISOTROPIC MAGNETIC POWDER AND A BONDED ANISOTROPIC MAGNET PRODUCED THEREFROM

This application is the U.S. national phase of International Application No. PCT/EP2003/013383 filed on Nov. 27, 2003, which application claims priority to German Patent Application No. 102 55 604.0 filed on Nov. 28, 2002, the contents of which are incorporated by reference herein.

BACKGROUND

1. Field

Disclosed herein is a method for producing anisotropic magnetic powder and/or a bonded anisotropic magnet produced from such a powder.

2. Description of Related Art

In the production of Nd—Fe—B sintered magnets, sintered magnetic residues, also known as magnetic scrap metal, are formed. This magnetic scrap metal is composed, for example, of end pieces of crude magnets, e.g., compression molded or isostatically pressed parts or blocks, parts that have been improperly coated or are useless either magnetically or because of their dimensions as well as excess quantities. This magnetic scrap metal has a relatively high metal value. However, reusing it for production of magnets poses problems and/or is expensive because in this state this material contains impurities, e.g., Ni, C, O which interfere with recycling. Current recycling options consist of using the magnetic scrap material in a new melt, where it is cut with newly weighed-in material. Furthermore it is possible to grind the magnetic scrap metal, remove most of the Ni impurities and process it in a mixture with another newly produced powder having a suitable composition to form sintered magnets. Ultimately, regeneration by direct reduction with calcium is also known. These recycling methods for production of new sintered magnets result in sacrifices in terms of the magnet quality or in high costs. Because of these problems in recycling, large quantities of magnetic scrap metal have already accumulated.

For the production of plastic-bonded magnets, impurities due to the use of magnetic metal scrap would be virtually irrelevant because they would constitute only an insignificant dilution based on their volume. However, if the magnetic scrap metal is to be bonded and the powder is to be processed to bonded magnets, then there is the problem that the coercitive field strength (Hc) decreases greatly during milling if the material does not already have an Hc deficiency. Due to the placement of the magnetic powder in air, the surface and thus the magnetic properties are further damaged by nucleation. Consequently such magnets would not be stable even when used at moderate temperatures or with weak opposing fields.

To produce high-quality anisotropically-bonded magnets based on Nd—Fe—B, German Patent DE 199 50 835 A1 (Aichi Steel) has disclosed a version of the so-called HDDR method. In this method, powder with a good anisotropy and coercitive field strength is manufactured from a lumpy Nd—Fe—B melt having an isotropic distribution of the c axes of the hard magnetic crystals by hydrogenation and dehydrogenation in a special process. For this process, a homogeneous melt which may contain hardly any α-Fe and free Nd must thus be used. In addition, a material with coarse columnar crystals should be used. This method is thus extremely complex and expensive as a result.

As shown in FIG. 2 which illustrates the crystallographic orientation of crystals in the HDDR process, problems occur due to the use of a cast block of an alloy based on NdFeB as the starting material. As shown by the figure on the left, a grain of a parent alloy which corresponds to a crystal has a crystallographic orientation of the c-axis. This orientation is usually different from the orientations of neighboring grains, i.e., there is a random distribution of the orientation of the c axes. The grains in the melt are also relatively coarse. In addition there is the problem of inhomogeneity due to coarse α-Fe and Nd-rich precipitation and deposition.

In the reverse phase transition, which is diagrammed in the middle drawing and/or the drawing on the right, a mixture of $RH_2$, Fe and $Fe_2B$ is formed from $R_2Fe_{14}B$, where R stands for a rare earth element. The reactions are explained by the fact that the crystallographic orientation of the c-axis of the $Fe_2B$ phase does not change, i.e., the orientation of $Fe_2B$ matches that of the grain of the parent alloy. Ultimately, a recombined microstructure is obtained, where the arrows denote the crystallographic orientation of the c-axis of the $R_2Fe_{14}BH_X$ phase. This phase orientation again corresponds to that of the phase of the parent alloy of the grain.

A similar process for production of anisotropic R-T-B magnetic powder which is also based on hydrogenation and dehydrogenation (HDDR) of fused alloys and its use for bonded magnets are described in German Patent DE 693 15 807.

One problem in the technical implementation of the HDDR method according to the state of the art is the influence of numerous parameters such as temperature, hydrogen pressure, etc., on the one hand, but on the other hand the composition and microstructure of the starting material (melt) also play an important role. This is expressed in a different anisotropy of the resulting melt, which may be manifested, e.g., as the ratio of remanence and saturation polarization, for example. A ratio approaching one is desired but is never achieved in practice.

SUMMARY

Accordingly, there remains a need for an improved method for producing an anisotropic magnetic powder and/or a bonded magnet from such a powder. This need is met by one or more of the embodiments disclosed herein.

This object is achieved by the methods for producing an anisotropic powder described herein and/or by a bonded magnet from powders produced in these ways.

In one embodiment is disclosed a method for producing an anisotropic magnetic powder, comprising: providing a starting material comprising an SE-TM-B alloy, wherein SE is a rare earth element and TM is a transition metal, said starting material comprising a magnetic material with an anisotropic orientation and an average grain size of less than 1 mm, said starting material further comprising a hard magnetic content greater than 90% by volume, or foreign phases smaller than 0.5 mm in size, or combinations thereof; producing a mixture having a $TM_XB$ phase in said starting material by a hydrogenation/dehydrogenation treatment comprising: a first hydrogenating comprising heating said starting material under a hydrogen pressure sufficient to produce a hydride, and then a second hydrogenating, comprising exposing the product of said first hydrogenating to a hydrogen pressure and an elevated temperature sufficient to induce a phase transition to produce said $TM_XB$ phase, and afterward dehydrogenating and producing a reverse phase transition to produce an anisotropic magnetic powder having a crystallographic orientation that matches a crystallographic orientation of said $TM_XB$ phase.

In another embodiment is disclosed a plastic or metal bonded magnet manufactured using a magnetic powder produced by the method described herein.

A method for producing an anisotropic magnetic powder using the HDDR method which is known per se is advantageous, but instead of using a melt with an isotropic distribution of the c axes of the hard magnetic crystals as the starting material, a magnetic material with anisotropy is used, i.e., the crystals are already oriented. It is thus possible to use magnetic scrap metal as the starting material, where this was not previously possible or practicable.

BRIEF DESCRIPTION OF DRAWINGS

An exemplary embodiment will now be explained in greater detail on the basis of the drawings, wherein:

FIG. 1 shows a flow chart for the process steps for producing an anisotropic magnetic powder and FIG. 2 shows the crystallographic orientation in a grain during and after the use of the HDDR method and FIG. 3 shows the crystallographic orientation of the starting material described herein before, during and after the use of the HDDR method.

DETAILED DESCRIPTION OF EMBODIMENTS

Figure 1:
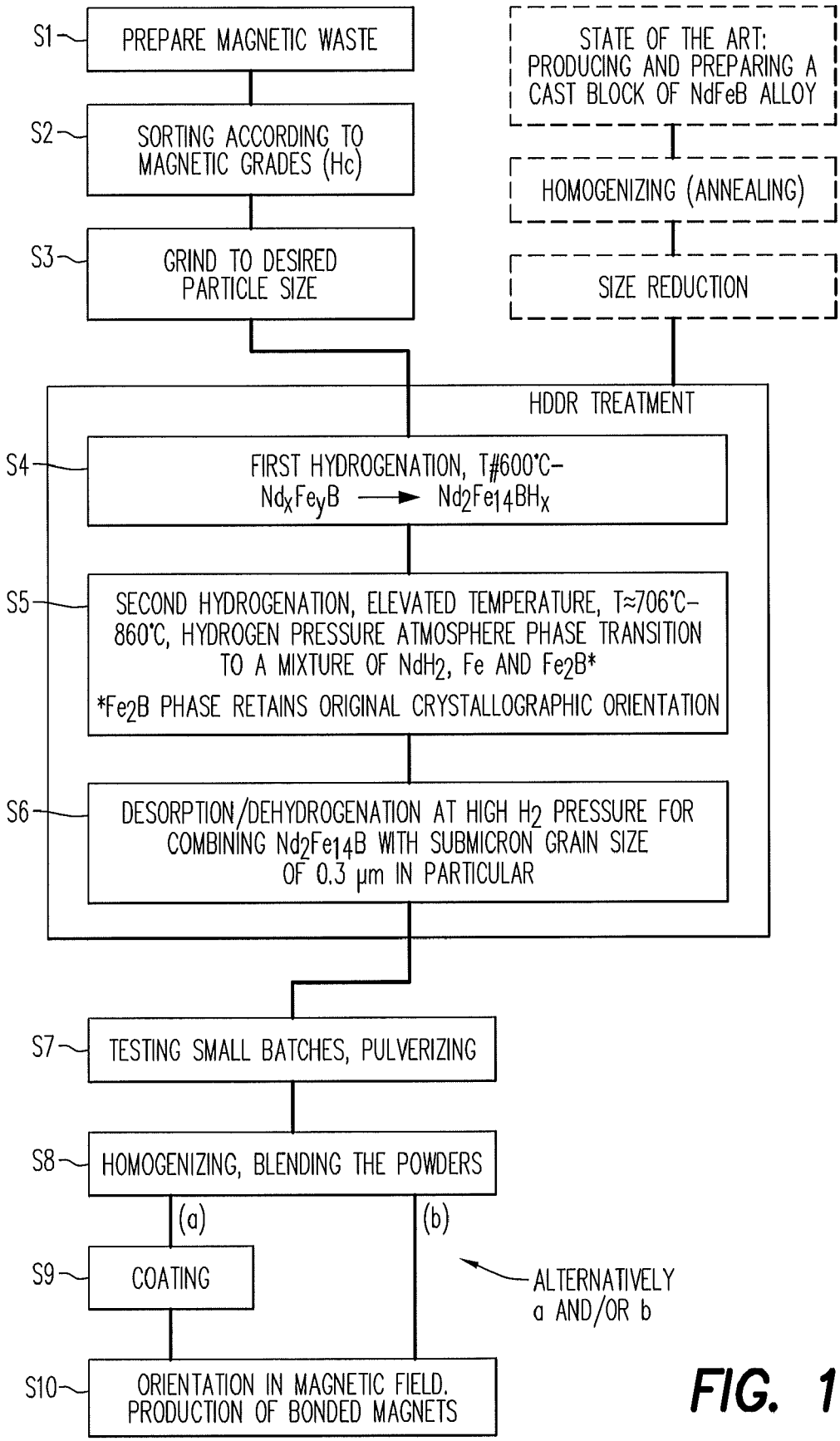

The starting material can desirably be crystals that are already oriented and have a fine crystal size and a more homogeneous distribution of foreign phases, e.g., oxides, α-Fe, Nd-rich phases, borides. With the known HDDR method, large grains and coarse deposition of unwanted foreign phases, such as free iron or phases with a high rare earth content, often having sizes in the range of several mm, must be accepted, but with the method described here, a starting material with an average particle size of less than 1 mm, a hard magnetic volume content of greater than 90% and foreign phases less than 0.5 mm in size are used. Magnetic scrap metal in particular is a starting material that is easy to process for use accordingly and meets these conditions. Using the hydrogenation and dehydrogenation and/or desorption processes on such a starting material ultimately makes available a powder which preferably has particles smaller than 0.5 mm in size. Advantageously a bonded magnet can be produced from this powder in an orienting magnetic field, offering an energy product BHmax of more than 10 MGOe (80 kJ/m$^3$), for example.

The magnet material is advantageously a permanent magnet material with a hard magnetic phase $SE_2TM_{14}B$ where SE stands for a rare earth element including Y and TM stands for a transition metal, e.g., Fe, Co or Ni. In addition, additives such as Si, Zr, Tb, Ga, Al, etc. including unavoidable amounts of C, O, N and S, may also be present. In particular, when using the powder for producing a plastic or metal bonded magnet, such additives cause little or no disadvantage.

The starting material can desirably consist of a lumpy material or a powder in which the crystal size amounts to at most 75% of the particle size. To do so, the starting material may be ground before the hydrogenation/dehydrogenation treatment and sorted by screening or fractionation and separated from foreign phase components. The starting material is expediently first collected separately according to magnet qualities (Hc) and cleaned to minimize impurities due to degreasing, pyrolysis, separation, etc. In addition, cleaning of the material surfaces may be accomplished by annealing the starting material in vacuo, under a noble gas or hydrogen. For example, desorption, deoxidation or decarburization reactions may be used.

After the hydrogenation/dehydrogenation treatment, a heat treatment is advantageously performed at a temperature of less than 600° C. under noble gas atmosphere or a vacuum atmosphere. This treatment reduces any traces of hydrogen that might still be present in the material and eliminates disturbances in the particle surface so that the stability of the powder and/or the magnet produced from it is/are increased. This is manifested in lower irreversible losses of the bonded magnets at elevated temperatures.

Preferably the material is ground to the desired particle size after the HDDR treatment or after the subsequent heat treatment, with an average particle size between 5 and 400 μm being advantageous. The powder ultimately achieved is advantageously tested in smaller batches and then homogenized by blending various powders. In particular, screening is advantageous to eliminate powder components larger than 0.5 mm in size.

It has been found, however, that this coarse fraction can be used after further size reduction and screening without any negative effect on the magnetic properties. This increase in yield is an essential advantage of the method described herein. With the traditional HDDR method using a melt as the starting material, precipitation products rich in iron and Nd can hardly be avoided; some can be separated through the coarse fraction after the treatment but are useless. The coarse fraction of the traditional material thus has definitely inferior properties in comparison with that prepared as described herein.

To counteract this disadvantage, an attempt is made in the traditional method to improve the molten starting material in an additional homogenization annealing step by distributing the coarse foreign phase fractions more uniformly and refining them. Experience has shown that this can be accomplished only incompletely, so that the advantages of the process described herein, which does not require this homogenization treatment at a high temperature, and the more uniform and powder quality which is essentially independent of particle size, are preserved.

It is also advantageous to limit the fraction of particles having a particle size smaller than 32 μm to a maximum of 10% of the total particles, because this fine fraction may have a lower coercitive field strength than the remaining material.

The powder may then be coated to prevent corrosion effects and the like. For example, organic antioxidants or metallic layers have a positive effect. The coating also reduces the irreversible losses at an elevated temperature and improves the corrosion resistance.

Ultimately, bonded magnets that have a degree of orientation of more than 70% (anisotropy ratio>0.7) in an advantageous embodiment are produced from this powder. The degree of filling of magnetic fractions and/or particles in such a bonded magnet may amount to 63 vol % or more in an especially preferred embodiment. In this discussion, the grain size is understood to refer to the crystal size and not the particle size. Foreign phases include all phase components whose magnetic properties (Br, HcJ) advantageously turn out to be less favorable by more than 50% than is the case with the hard magnetic phase. Magnetic scrap metal is generally understood to include magnetic metals and magnets that cannot be used for various reasons. For example, magnetic scrap metal may consist of parts that are magnetically or visually inadequate or improperly coated or that have incorrect dimensions.

A bonded magnet is understood to be a magnet produced by bonding a powder containing the hard magnetic phase in a plastic or metal matrix. The degree of filling refers in general to the percentage volume amount (%) of the metal powder with respect to the total volume of the magnet.

As shown in FIG. 1, magnetic materials having anisotropy, i.e., already oriented crystals and a largely homogeneous fine-grained structure, are used as the starting material. Thus magnetic waste and/or scrap magnetic metal may be used as the starting material to advantage (step S1).

The magnetic material has crystals that are already oriented, whereby the crystal size should be finer than in the case of using a cast block of an alloy based on NdFeB according to the known HDDR method. Due to the selected starting material, this usually also yields a more homogeneous distribution of the foreign phases (e.g., oxides, α-Fe, Nd-rich phase, boride), so the HDDR method can be used to particular advantage. $SE_2TM_{14}B$ is advantageously used as the starting material, where SE stands for a rare earth element, including Y, and TM stands for a transition metal including Fe, Co, Ni, etc. Additives such as Si, Zr, Y, Tb, Ga, Al, Nb, Hf, W, V, Mo, Ti, etc. are also possible, including unavoidable amounts of C, O, N and S, as is general knowledge.

The starting material is advantageously sorted, in particular sorted according to magnetic qualities and magnetic materials (step S2). This yields a particularly narrow distribution of the coercitive field strengths of the particles.

The individual sorted batches are expediently cleaned subsequently, in particular by degreasing, pyrolyzing and separating them. Then the starting material is ground to the desired powder particle size, in particular to powder with particles smaller than 0.5 mm in size (step S3). Cleaning by annealing in vacuo, in noble gas, or in hydrogen removes oxygen and carbon, in particular from the surface of the starting material.

It is also advantageous to separate unwanted impurities such as layer residues, dust, etc., e.g., by screening.

The HDDR method, a version of which is described in German Patent DE 199 50 835 A1, is described below with reference to the full content of the description there (steps S4 through S6).

In the HDDR treatment, in a first step, hydrogenation is performed on the starting material, e.g., an alloy based on NdFeB at a low temperature (step S4). The alloy based on NdFeB absorbs hydrogen under a high hydrogen pressure and below a temperature of 600° C. in particular so that it becomes hydride of $Nd_2Fe_{14}BH_X$ which stores enough hydrogen to induce a disproportionation reaction. Then the hydride is subjected to a second hydrogenation at an elevated temperature (step S5). In this process, the hydride is heated to a temperature of 760° C., to 860° C. for the disproportionation reaction under a suitable hydrogen pressure, which supplies the hydrogen required for the disproportionation reaction after consumption of the stored hydrogen. Therefore a uniform phase transition takes place at a suitable reaction rate, producing a mixture of $NdH_2$, Fe and $Fe_2B$. The $Fe_2B$ phase is formed to such an extent that it has the original crystallographic orientation and is transferred to the newly formed $Nd_2Fe_{14}B$ grains in subsequent recombination (step S6, described below). The crystallographic orientation is illustrated in the diagrams in FIG. 2. It can be seen that the crystallographic orientation of the $Fe_2B$ phase and the crystallographic orientation of the $Nd_2Fe_{14}B$ matrix phase match.

In another step (S6) a dehydrogenation or desorption process is performed for recombination of the mixture, where $Nd_2Fe_{14}B$ with a submicron grain size of preferably approximately 0.3 μm is formed.

Since the powder particles produced by this process contain a multitude of submicron grains, a very good anisotropy of these grains is crucial for the anisotropy of the magnet produced from the powder.

By using the magnetic material which is already anisotropic as the starting material, the development of the anisotropy of the powder produced as described herein is even better. An important reason for this is that in size reduction of the material treated with HDDR, transition zones with a different orientation are prevented. This is explained further below and is illustrated in FIGS. 2 and 3.

Starting with the finer grains of the anisotropic starting material with an average grain size of <1 mm, preferably <0.1 mm, even smaller submicron grain sizes are advantageously formed. In a first desorption step, the reverse phase transition is performed as uniformly as possible by keeping the hydrogen pressure so high that the desorption reaction can be maintained. The recombined $Nd_2Fe_{14}B$ matrix grows by retaining its crystallographic orientation in agreement with the crystallographic orientation of the $Fe_2B$ phase. In this process, the alloy again becomes a hydride of $Nd_2Fe_{14}BH_X$ because a large amount of hydrogen is still present in the alloy. Therefore the hydrogen is then dehydrogenated or desorbed as completely as possible out of the alloy under a high vacuum.

The recombined $Nd_2Fe_{14}B$ matrix in agreement with the original crystallographic orientation has a high degree of orientation with the crystallographic grain orientation so that a high anisotropy is imparted to the magnet and/or magnetic powder. At the same time, the phase has a fine and uniformly granular microstructure which yields a high coercitive force Hc.

Figure 3:
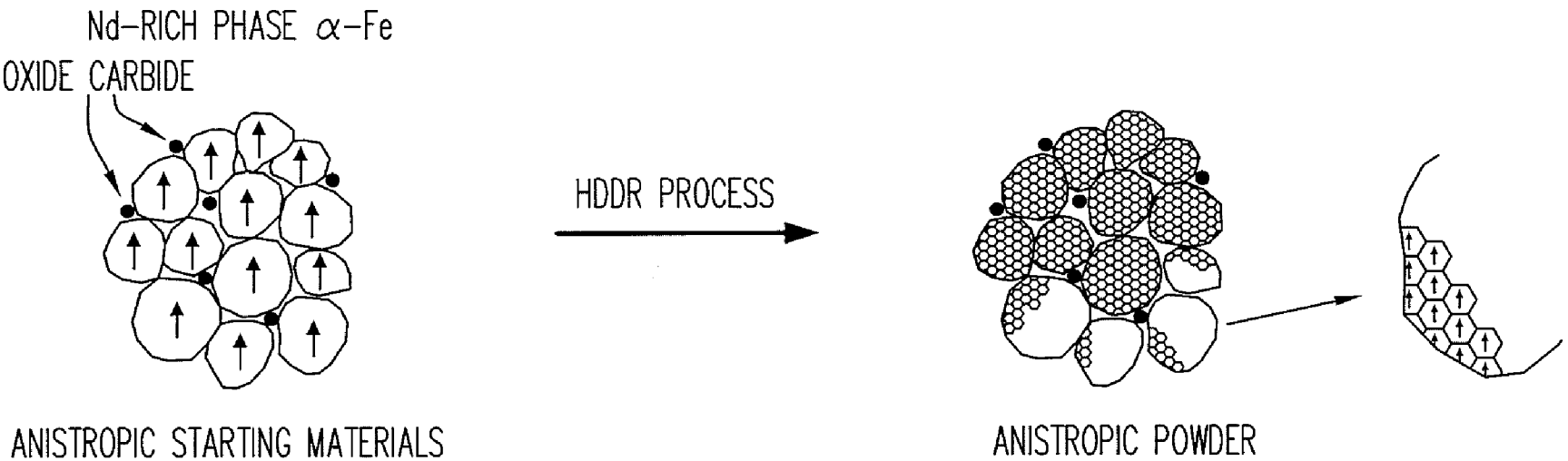

FIG. 3 shows the anisotropic starting material before and after the HDDR treatment. In comparison with FIG. 2, it is clear here that the direction of the fracture face in size reduction of the treated material is irrelevant. In the traditional process, however, it is unavoidable that the fracture runs through regions with a different orientation on the whole. As a result of this, many powder particles in the internal regions have different orientations. After aligning these particles in a magnetic field to produce an anisotropic magnet, this disordered orientation is of course retained.

In the process described herein, regions of different orientation are not formed, so an even higher degree of anisotropy of the powder (preferably more than 0.8) is achieved.

The anisotropic magnetic powder produced in this way has excellent magnetic properties and may be used to produce, for example, bonded magnets or sintered magnets.

In another optional process step (S7) after the HDDR treatment, a test is advantageously performed on smaller batches. If needed, another pulverization step is also performed. Frequently also a homogenization operation by blending powders having different properties from different batches is also advantageous (step S8). This powder can then be used for producing bonded magnets in an orienting magnetic field (step S10). Before production of the bonded magnet or a sintered magnet (step S10), it is also possible to coat the powder (step S9).

The magnetic powder produced in this way is preferably freed of coarse fractions larger than 0.5 mm in size in the steps after the HDDR treatment. Magnetic powder having a fraction of particles having a size <32 μm that is 10% or less of the total particles is preferred. A renewed heat treatment up to 600° C. or lower in a noble gas atmosphere or a vacuum atmosphere is also advantageous.

With respect to the alloy, a variety of materials are available. One or more rare earth elements may be selected, for example, from the group consisting of yttrium (Y), lanthanum (La), cerium (Ce), praseodymium (Pr), neodymium (Nd), samarium (Sm), gadolinium (Gd), terbium (Tb), dysprosium (Dy), holmium (Ho), erbium (Er), thulium (Tm) and lutetium (Lu). Iron (Fe) and boron (B) with unavoidable impurities are usually also components of the powder. Neodymium (Nd) is especially preferred as the rare earth element. To improve the magnetic properties, other materials, e.g., Ga or niobium (Nb) may also be added. In particular, preferably one or more elements from the list including Al, Si, Ti, V, Cr, Mn, Ni, Cu, Ge, Zr, Mo, In, Sn, Hf, Ta, W and Pb should also be added to improve the coercitive force and the orthogonality of the demagnetization curve. The Curie temperature of the alloy can be raised by adding the element Co to improve the magnetic properties at elevated temperatures.

In particular a high-frequency oven or a smelting furnace may be used to perform the HDDR method disclosed herein such as that disclosed in German Patent DE 199 50 835 A1 for performing the HDDR method.

The production of bonded or sintered magnets from the particles produced herein may be performed in an essentially known way. For example, the magnetic powder produced may be mixed with a solid epoxy powder in a ratio of 3 wt % and then pressed in a mold using a press equipped with an electromagnet and a heating element at a high temperature in a magnetic field of 20 kOe (16 kA/cm), for example. Preferably, however, bonded magnets with an energy product BHmax of more than 10 MGOe (80 kJ/m$^3$) is preferred.

Such a magnet advantageously has a degree of orientation of 70% (anisotropy ratio 0.7) or more. The degree of filling of magnetic components preferably amounts to at least 63 vol %.

The invention having been described above with reference to certain specific embodiments thereof, it will be recognized that these embodiments do not limit the scope of the appended claims.

The invention claimed is:

1. A method for producing an anisotropic magnetic powder, comprising:

providing a starting material comprising an SE-TM-B alloy, wherein SE is a rare earth element and TM is a transition metal, said starting material comprising a magnetic material with an anisotropic orientation and an average grain size of less than 0.1 mm, said starting material further comprising a hard magnetic content greater than 90% by volume, foreign phases smaller than 0.5 mm in size, and a crystal size and article size such that the crystal size is at most 75% of the particle size;

producing a mixture comprising a $TM_xB$ phase in said starting material by a hydrogenation/dehydrogenation treatment without homogenization treatment at high temperate comprising:

a first hydrogenation comprising heating said starting material comprising said SE-TM-B alloy under a hydrogen pressure sufficient to produce a hydride of the SE-TM-B alloy, and then a second hydrogenation comprising exposing the hydride resulting from said first hydrogenation to a hydrogen pressure and an elevated temperature sufficient to induce a phase transition to produce said $TM_xB$ phase, and afterward dehydrogenating and producing a reverse phase transition to produce an anisotropic magnetic powder having a crystallographic orientation that matches a crystallographic orientation of said $TM_xB$ phase and that has a fine and uniformly granular microstructure.

2. A method for producing an anisotropic magnetic powder from magnetic scrap material to be recycled, comprising:

providing a starting material comprising an SE-TM-B alloy, wherein SE is a rare earth element and TM is a transition metal, said starting material comprising magnetic scrap metal having an average grain size smaller than 0.1 mm, and a crystal size and a particle size such that the crystal size is at most 75% of the particle size, producing a mixture having a $TM_xB$ phase in said starting material by a hydrogenation/dehydrogenation treatment, comprising:

a first hydrogenation comprising heating said starting material under a hydrogenation pressure sufficient to create a hydride of the SE-TM-B alloy, and then a second hydrogenation comprising exposing the product of said first hydrogenation, comprising exposing the product of said first hydrogenating to a hydrogen pressure and at elevated temperature sufficient to induce a phase transition to produce said $TM_xB$ phase, and afterward dehydrogenating and producing a reverse phase transition to produce an anisotropic magnetic powder having a crystallographic orientation that matches a crystallographic orientation of said $TM_xB$ phase and that has a fine and uniformly granular microstructure.

3. The method according to claim 1, in which the starting material comprises a permanent magnetic material having a hard magnetic phase $SE_2TM_{14}B$, wherein SE is a rare earth element and TM is a transition metal.

4. The method according to claim 1, wherein the magnetic material comprises at least one of the elements Fe, Ni or Co as the transition metal TM.

5. The method according to claim 1, wherein the magnetic material further comprises additives including amounts of C, O, N and/or S.

6. The method according to claim 1, further comprising grinding, and screening or fractionating the starting material before the hydrogenation/dehydrogenation treatment.

7. The method according to claim 1, wherein the starting material comprises a magnetic powder.

8. The method according to claim 1, further comprising cleaning the starting material.

9. The method according to claim 8, wherein said cleaning comprises annealing the starting material in vacuo, in a noble gas or in hydrogen before the hydrogenation/dehydrogenation treatment.

10. The method according to claim 1, further comprising heat treating the magnetic powder after the hydrogenation/dehydrogenation treatment.

11. The method according to claim 1, further comprising homogenizing the magnetic powder by blending.

12. The method according to claim 1, further comprising screening the magnetic powder produced so that it is freed of a coarse fraction having particles greater than 0.5 mm in size.

13. The method according to claim 1, wherein the magnetic powder has a fraction of particles having a size <32 μm that is less than or equal to 10% of the particles.

14. The method according to claim 1, wherein the magnetic powder is coated.

15. The method according to claim 1, wherein B is partially replaced by C.

16. A plastic or metal bonded magnet manufactured using a magnetic powder produced by the method according to claim 1.

17. The magnet according to claim 16, having an energy product BHmax greater than 80 kJ/m$^3$.

18. The magnet according to claim 16, having a degree of orientation equal to or greater than 70%.

19. The method according to claim 16, having a degree of filling of magnetic fractions of at least 63 vol %.

20. The method according to claim 1, wherein $TM_xB$ is $Fe_2B$.

21. The method according to claim 2, wherein $TM_XB$ is $Fe_2B$.

22. The method according to claim 1, wherein SE comprises yttrium.

23. The method according to claim 2, wherein SE comprises yttrium.

24. The method according to claim 8, wherein said cleaning comprises removing foreign phase fractions.

25. The method according to claim 1, wherein said dehydrogenating and producing a reverse phase transition comprises a first desorption carried out under hydrogen pressure, followed by a second desorption carried out under high vacuum.

26. The method according to claim 10, wherein said heat treating comprises treating at a temperature up to 600° C. under a noble gas atmosphere or under a vacuum.

27. A method for producing an anisotropic magnetic powder, comprising:

providing a starting material comprising an SE-TM-B alloy, wherein SE is a rare earth element and TM is a transition metal, said starting material comprising a magnetic material with an anisotropic orientation and an average grain size of less than 1 mm, said starting material further comprising a hard magnetic content greater than 90% by volume, and foreign phases smaller than 0.5 mm in size;

producing a mixture comprising a $TM_XB$ phase in said starting material by a hydrogenation/dehydrogenation treatment without homogenization treatment at high temperate comprising:

a first hydrogenation comprising heating at a first temperature said starting material comprising said SE-TM-B alloy under a hydrogen pressure sufficient to produce a hydride of the SE-TM-B alloy, and then a second hydrogenation comprising exposing the hydride resulting from said first hydrogenation to a hydrogen pressure and an elevated temperature above said first temperature and sufficient to induce a phase transition to produce said $TM_XB$ phase, and afterward dehydrogenating and producing a reverse phase transition to produce an anisotropic magnetic powder having a crystallographic orientation that matches a crystallographic orientation of said $TM_XB$ phase and that has a fine and uniformly granular microstructure.

28. The method of claim 27, wherein said first temperature is below 600° C. and said second temperature is in the range of 760° C. to 860° C.

* * * * *